United States Patent [19]

Kiyota et al.

[11] Patent Number: 5,055,128

[45] Date of Patent: Oct. 8, 1991

[54] SINTERED FE-CO TYPE MAGNETIC MATERIALS

[75] Inventors: Yoshisato Kiyota; Osamu Furukimi, both of Chiba, Japan

[73] Assignee: Kawasaki Steel Corporation, Japan

[21] Appl. No.: 460,097

[22] PCT Filed: May 30, 1989

[86] PCT No.: PCT/JP89/00537

§ 371 Date: Jan. 24, 1990

§ 102(e) Date: Jan. 24, 1990

[87] PCT Pub. No.: W)89/12112

PCT Pub. Date: Dec. 14, 1989

[30] Foreign Application Priority Data

May 30, 1988 [JP] Japan ..... 63-130088
Aug. 20, 1988 [JP] Japan ..... 63-206707
Aug. 20, 1988 [JP] Japan ..... 63-206710

[51] Int. Cl.[5] ..... B22F 9/00

[52] U.S. Cl. ..... 75/246; 419/23; 419/36; 419/37; 419/54

[58] Field of Search ..... 419/23, 36, 37, 54; 75/246

[56] References Cited

U.S. PATENT DOCUMENTS 3,891,475 6/1975 Tomita et al. ..... 148/318
4,097,275 6/1978 Horvath ..... 75/246
4,251,273 2/1981 Smith et al. ..... 75/246
4,721,599 1/1988 Nakamura ..... 419/23

OTHER PUBLICATIONS

IEE Transactions on Magnetics, W. Yamagishi, et al., 5/9/86, vol. MAG-22, No. 5 pp. 641-653.
Chemical Abstracts, Hitachi Metals, Ltd., 1/28/85, vol. 102, No. 4, p. 906.
Chemical Abstracts, Akai Electric Co., Ltd., 12/13/76, vol. 85, No. 24, p. 240.

*Primary Examiner*—Stephen J. Lechert, Jr.
*Attorney, Agent, or Firm*—Austin R. Miller

[57] ABSTRACT

Disclosed herein is an economical process for the production of a sintered Fe-Co type, Fe-Co-V type or Fe-Co-Cr type magnetic material, which comprises preparing an alloy powder of at least Fe and Co metals or a like powder, kneading it with an organic binder, conducting injection molding and debinding, and then conducting a two-stage sintering treatment consisting of low-temperature sintering and high-temperature sintering. Magnetic materials having a specific composition of the Fe-Co, Fe-Co-V or Fe-Co-Cr type and excellent magnetic properties and a low core loss value are also disclosed.

3 Claims, 1 Drawing Sheet

SINTERED FE-CO TYPE MAGNETIC MATERIALS

TECHNICAL FIELD

This invention relates to a process for producing sintered Fe-Co type magnetic materials having excellent dc or ac magnetic properties by injection molding and also to soft magnetic materials thus obtained.

BACKGROUND ART

Alloys of the Fe-Co type are known as soft magnetic materials having a maximum saturated magnetic flux density amongst all magnetic materials. They are expected to have utility for motors and magnetic yokes which are required to transmit high magnetic energy in spite of small dimensions. Fe-Co type alloys in the form of ingots are however accompanied by the drawback that they do not practically permit cold working because of their brittleness.

It has hence been attempted to improve the cold workability by adding vanadium. No sufficient cold workability has however been achieved yet, although some improvements are observed.

Powder metallurgy are considered to be a useful means for overcoming such poor workability. This process however has difficulties in achieving densification of sintered products, so that materials having practical magnetic properties have not been obtained. A variety of methods have hence been proposed.

For example, it is attempted in Japanese Patent Application Laid-Open No. 291934/1986 to improve the compressibility and sinterability by using an Fe-Co alloy in which no ordered lattices have been formed. In Japanese Patent Application Laid-Open No. 54041/1987, the sintered density has been improved by hot isostatic press (HIP) processing. In Japanese Patent Application Laid-Open No. 142750/1987, the green density and sintered density have been improved by using a coarse Fe-Co alloy powder and a fine Co powder in combination.

However, all of these proposals use compression forming. They can use only poor-sinterability coarse powders of such a size that the compressibility is not impaired and the powders are not taken into mold clearances. The resulting sintered materials therefore have low magnetic properties. There has thus been a demand for sintered materials having still higher magnetic properties.

Further, Japanese Patent Application Laid-Open No. 85650/1980 discloses the attempted production of a high-density sintered material by adding 0.1–0.4% of boron to an alloy of the Fe-Co type.

On the other hand, Japanese Patent Publication No. 38663/1982 (Japanese Patent Application Laid-Open No. 85649/1980) discloses the attempted production of a high-density sintered material by adding 0.05–0.7% of phosphorus to an alloy of the Fe-Co type.

However, all of these methods enhances densification by using the formation of a transitional liquid phase in the course of sintering, which in turn relies upon a third element. It is thus necessary to strictly control the sintering temperature within a narrow range, thereby making it difficult to achieve a high yield upon mass production. Moreover, the elements whose addition is proposed are considered to aggravate the brittleness of Fe-Co alloys, leading to the problem that cracking or chipping may take place in a working step in which sintered products are finished into precision parts.

In addition, Japanese Patent Application Laid-Open Nos. 291934/1986 and 142750/1987 require a sintering treatment at a temperature as high as 1300°–1400° C., while Japanese Patent Application Laid-Open No. 54041/1987 needs a high pressure of at least 800 atm in addition to the sintering at a high temperature of about 1300° C. It is hence not only difficult to conduct mass production but also necessary to use special facilities. The methods of these publications are therefore not economical.

On the other hand, materials consisting practically of Fe and Co alone have a low electrical resistivity and their core loss values increase when employed under ac power. It may hence be contemplated to add a third component to a material of the Fe-Co type. For example, materials of the Fe-Co-V type exhibit improved ac properties. However, such a third component involves a problem that it is prone to oxidation upon sintering. This approach therefore has the problem of inferior dc properties as long as a production process capable of inhibiting oxidation is not developed.

An object of this invention is to provide a sintered Fe-Co type magnetic material which can be worked into intricate shapes, has excellent dc magnetic properties, a low core loss and a high saturated magnetic flux density, and also to provide its production process excellent in economy.

Another object of this invention is to provide a sintered Fe-Co type magnetic material having a small core loss value when employed under ac power and superb ac magnetic properties, and also to provide a production process thereof, said process featuring easy molding and the possibility of elimination of C, derived from an organic binder, without extreme oxidation of its components.

DISCLOSURE OF THE INVENTION

To achieve the above objects, in a first aspect of this invention, there is thus provided a process for the production of a sintered Fe-Co type magnetic material, which comprises preparing an alloy powder and/or mixed powder of at least Fe and Co metals, kneading the alloy power and/or mixed powder with at least one organic binder, subjecting the resultant compound to injection molding and debinding, and then subjecting the thus-obtained debound body to a two-stage sintering treatment consisting of low-temperature sintering and high-temperature sintering.

In a second aspect of this invention, there is also provided a process for the production of a sintered Fe-Co type magnetic material. The alloy powder and/or mixed powder of Fe and Co metals is a mixed powder of an Fe powder having an average particle size of 2–15 μm and a Co powder having an average particle size of 1–10 μm, an Fe-Co alloy powder having an average particle size of 3–10 μm, or a mixed powder of at least one of an Fe powder and a Co powder, both having an average particle size of 3–10 μm, and an Fe-Co alloy powder having an average particle size of 3–10 μm, said first-mentioned mixed powder, second-mentioned Fe-Co alloy powder or third-mentioned mixed powder having been prepared to have a final composition in which Co accounts for 15–60 wt. % and Fe substantially accounts for the remainder. The two-stage sintering treatment comprises sintering the debound body at an α-phase range temperature of 800°-950° C. and then at a $\gamma$-phase range temperature of at least 1000° C.

Preferably, the sintering in the $\alpha$-phase range of 800°-950° C. is conducted in a reduction gas atmosphere.

In a third aspect of this invention, there is also provided a process for the production of a sintered Fe-Co type magnetic material. The alloy powder and/or mixed powder of Fe and Co metals is an alloy powder and/or mixed powder having an average particle size of 3-25 $\mu$m and prepared to have a final composition in which Co accounts for 15-60 wt. %, V for 0.5-3.5 wt. % and Fe substantially for the remainder. The two-stage sintering treatment comprises sintering the debound body at 1000°-1300° C. in a reduction gas atmosphere or a reduced-pressure atmosphere not higher than 30 Torr and then at a temperature, which is at least 50° C. higher than the preceding sintering temperature, in an inert gas atmosphere.

In a fourth aspect of this invention, there is also provided a process for the production of a sintered Fe-Co type magnetic material. The alloy powder and/or mixed powder of Fe and Co metals comprises an Fe powder having an average particle size of 2-15 $\mu$m, at least one powder selected from a Co powder having an average particle size of 1-10 $\mu$m or an Fe-Co alloy powder having an average particle size of 3-10 $\mu$m and at least one powder selected from a Cr and/or Cr oxide powder having an average particle size of 1-30 $\mu$m or an Fe-Cr alloy powder having an average particle size of 2-30 $\mu$m and is prepared to have a final composition in which Co accounts for 20-50 wt. %, Cr for 0.5-3.5 wt. % and Fe substantially for the remainder. The two-stage sintering treatment comprises sintering the debound body at 1000-1350° C. in a reduced-pressure atmosphere not higher than 30 Torr and then at a temperature, which is at least 50° C. higher than the preceding sintering temperature, in a non-oxidizing atmosphere.

Further, in fifth, sixth and seventh aspects of this invention, there are also provided sintered Fe-Co type magnetic materials having compositions and physical properties of the Fe-Co type, Fe-Co-V type and Fe-Co-Cr type, respectively.

BEST MODE FOR CARRYING OUT THE INVENTION

Figure 1:
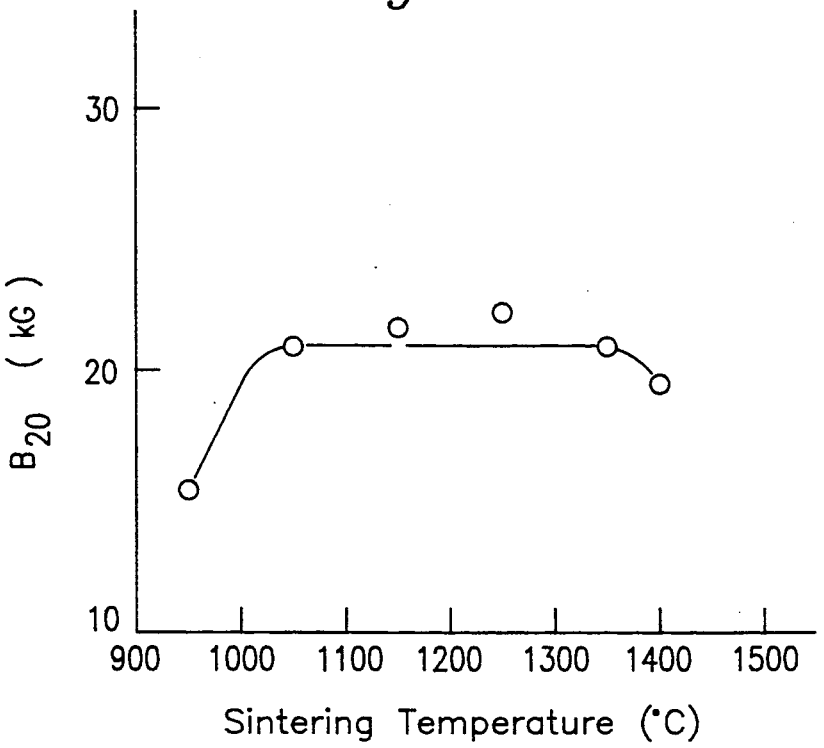
FIG. 1 is a graph showing results of Example 7 and diagrammatically illustrates magnetic flux densities $B_{20}$ as a function of the sintering temperature.

This invention will hereinafter be described in detail.

First of all, the production process according to the first aspect of this invention will be described.

In the production process of this invention, a metal powder is kneaded with an organic binder, followed by injection molding and debinding. The resultant debound body is then subjected to two-stage sintering treatment which is conducted under different conditions. In particular, the present invention primarily features that injection molding permitting the formation of complex shapes is adopted instead of compression forming which has heretofore been employed generally. In contrast to the fact that raw material powders are limited to coarse powders having poor sinterability in compression forming, injection molding has an advantage that fine powders having high sinterability can be used. This has made it possible to improve the conventional low magnetic properties. The subsequent two-stage sintering treatment under different conditions chosen properly can economically produce a sintered material having a high density and excellent magnetic properties.

Starting raw material powders, which make up the raw material powder useful in the present invention, are metal or alloy powders prepared by a high-pressure water atomizing technique, a reduction technique, a carbonyl technique or the like. It is possible to choose a carbonyl Fe powder, water-atomized Fe powder, reduced Fe powder or the like as an iron source; an atomized Co powder, reduced Co powder, ground Co powder or the like as a cobalt source; and an atomized Fe-Co powder, ground Fe-Co powder or the like as an iron and cobalt source. They are used after adjusting their particle sizes to desired ranges by classification or grinding.

The above-described starting raw materials may be used singly or as a mixed powder to provide a raw material powder useful in the practice of this invention. Regarding the purity of the raw material powder, it is sufficient if impurities other than C, 0 and N, which can be eliminated in the course of sintering, are practically ignorable. In general, powders in which the sum of Fe and Co accounts for 97-99 wt. % can be used.

Conventionally-known binders composed principally of one or more of thermoplastic resins and waxes or a mixture thereof can be used in this invention. One or more of plasticizers, lubricants, debinding promoters and the like may also be added as needed.

As the thermoplastic resin, it is possible to choose one of acrylic resins, polyethylene resins, polypropylene resins, polystyrene resins, vinyl chloride resins, vinylidene chloride resins, vinyl acetate resins and cellulose resins or a mixture or copolymer of two or more of these resins. As the wax, it is possible to choose and use one or more of natural waxes led by bees wax, Japan wax, montan wax and the like and synthetic waxes represented by low-molecular polyethylene, microcrystalline wax, paraffin wax and the like. The plasticizer is selected depending on the resin or wax which is a base material and with which the plasticizer is combined. Dioctyl phthalate (DOP), diethyl phthalate (DEP), diheptyl phthalate (DHP) or the like can be used. As the lubricant, one or more of higher fatty acids, fatty acid amides, fatty acid esters and the like can be used. In some instances, the wax may also be used as a lubricant. Further, a sublimable substance such as camphor may also be added to promote debinding.

The amount of a binder to be added is from 45 to 60 vol. % of the whole volume, the remaining volume being the raw material metal powder. It can be adjusted in view of the molding readiness of the shape to be formed and the debindability.

For the mixing and kneading of the iron powder and binder, a kneader of the batch type or continuous type can be used. After the kneading, granulation is effected using a pelletizer or grinding mill to obtain a molding raw material.

The molding raw material can be molded by using a conventional plastic injection molding machine.

The green body thus obtained is subjected to a debinding treatment in the atmosphere or in a surrounding gas.

This is a step which is conducted to eliminate the binder after the molding. No particular limitation is imposed on it. For example, the green body may be heated at a constant rate in a non-oxidizing atmosphere such as a reduction gas atmosphere, inert gas atmosphere or reduced-pressure atmosphere and then maintained at a temperature of 400°-700° C. therein. It is preferable to raise the temperature at a rate of 5°-100° C./hr because unduly high heating rates tend to result in the development of cracks and bulges in the final product.

The two-stage sintering treatment which is a characteristic feature of this invention comprises sintering at a relatively low temperature and sintering at a relatively high temperature. The "low temperature" and "high temperature" as used herein vary depending on whether the composition contains V or Cr which is only sparingly reducible. Where the composition contains neither V nor Cr, crystal grains of the sintering material undergo considerable growth when heated past the transformation point. The reduction of the Fe and Co oxides can be completed below the transformation point. The temperature range lower than the $\alpha$ to $\gamma$ transformation point, which will be described subsequently, is called low temperatures, while temperatures higher than the transformation point are called high temperatures. Accordingly, the low temperature and high temperature can be determined definitely depending on the transformation point. Where V and C are contained, crystal grains of the sintering material do not undergo substantial growth because of the inclusion of the oxides of V and Cr even when heated past the transformation point. It is difficult to reduce the oxides of V and Cr at temperatures lower than 1000° C. A temperature range which permits most effective reduction of the oxides of V and Cr is called "low temperatures", while a temperature range at least 50° C. higher than the low temperatures is called "high temperatures". Therefore, the low temperature and high temperature are determined relative to the temperature (low temperature) at which the oxides of V and Cr were actually reduced. Sintering on the low-temperature side eliminates C, O and other impurities to densify the material and also closes up voids in the material, while preventing excess growth of crystal grains in the material. As a principle, the low temperature is set at the temperature at which the sintering speed of a material of the Fe-Co type begins to accelerate. Since unduly high temperatures induce excessive progress of sintering of powders themselves and result in excessive growth of crystal grains, such unduly high temperatures impair densification and void elimination and closure. When a third component, for example, V or Cr is added to an Fe-Co system, it is preferred to choose conditions capable of preventing oxidation, in other words, inducing reduction as much as possible because V is susceptible to oxidation. Further, Co and Cr tend to evaporate from the surface of the material It is therefore necessary to choose conditions which can minimize their evaporation.

Sintering on the high temperature side is needed to induce growth of crystal grains in the material and densification. In addition, the material is sintered in a temperature range where each component has a high diffusion velocity, whereby the material is homogenized. By this high-temperature sintering, the magnetic properties are improved further.

Although no particular limitation is necessarily imposed on the atmosphere gas for the sintering treatment, it is preferable to use a reduced-pressure atmosphere or reduction gas atmosphere for the low-temperature sintering and an inert gas atmosphere for the high-temperature sintering.

Further, the material whose sintering has been completed may be subjected to magnetic annealing as needed. Magnetic annealing can be conducted at a temperature of 800°-950° C. or so in a non-oxidizing atmosphere.

A description will next be made of the production process according to the second aspect of this invention.

The present inventors have found that the magnetic properties of a sintered body is closely related to the particle size of the raw material powder. The average particle size of a raw material powder governs the sintered density. Particle sizes greater than a certain upper limit cannot provide any sintered material according to this invention. When a mixed powder of an Fe powder and a Co powder is used as a raw material powder, it is impossible to achieve a sintered density ratio of 95% or higher and hence to obtain a sintered material of this invention provided that the average particle size of the Fe powder exceeds 15 μm or the average particle size of the Co powder is greater than 10 μm. When an Fe-Co alloy powder is used, sintered densities of 95% or higher cannot be obtained should the average particle size exceed 10 μm. When a mixed powder composed of at least one of an Fe powder and a Co powder and an Fe-Co alloy powder is used, sintered densities of 95% or higher cannot be obtained should the average particle size exceed 10 μm. On the other hand, when the average particle sizes of the above-described Fe powder, Co powder, Fe-Co alloy powder, and mixed powder composed of at least one of the Fe powder and Co powder and the Fe-Co alloy powder are smaller than 2 μm, 1 μm, 3 μm and 3 μm, respectively, improvements in the magnetic properties are not substantial but the prices of the powders become very high. It is therefore not economical to use such fine powders. With the foregoing in view, when a mixed powder of an Fe powder and a Co powder is used as a raw material powder, the average particle sizes of the Fe powder and Co powders should be limited to 2-15 μm and 1-10 μm, respectively. When an Fe-Co alloy powder is used on the other hand, the average particle size should be limited to 3-10 μm. Further, when a mixed powder composed of at least one of an Fe powder and a Co powder and an Fe-Co alloy powder is used, the average particle size should be limited to 3-10 μm.

It is necessary to carefully control sintering conditions, because they affect the density, void shape, crystal grain size, impurity levels, etc. of the sintered material.

In the case of an injection-molded body using a raw material powder of the above-described particle size, a sintered material having better magnetic properties than conventional sintered materials can be obtained even when its sintering is conducted only at a relatively low temperature in the $\alpha$-phase temperature range. However, two-stage sintering is conducted under different conditions in the second aspect of this invention. First of all, sintering is conducted at a temperature in the $\alpha$-phase range. The term "$\alpha$-phase" as use herein means the α phase in the composition of the sintered final product. This α-phase sintering is effective in increasing the sintered density ratio of the sintered final product. The present inventors have found that when a powder having a smaller average particle size like the raw material useful in the present invention is sintered, significant crystal growth takes place in a composition of the Fe-Co type if the temperature is raised immediately from the α phase, the low temperature phase, to the γ phase which is the high temperature phase.

As a result of this crystal growth, voids are left over among crystal grains so that the attempted increase of the sintered density ratio is impaired. On the other hand, no crystal growth takes place in α-phase sintering, whereby crystal grain boundaries are fixed at voids. It is hence possible to easily eliminate the voids by allowing to diffuse in atomic level through the crystal grain boundaries. As a result, the sintered density ratio can be increased sufficiently. Incidentally, the α-phase sintering may be repeated twice or more. The preferable temperature range for the α-phase sinter is 800°–950° C., while the holding time is 0.5–4 hr. Temperatures lower than 800° C. cannot achieve sufficient sintering, whereas temperatures higher than 950° C. induce transformation.

The magnetic properties have been improved even as the α-phase sintering. In order to obtain still better magnetic properties, additional sintering is conducted subsequent to the α-phase sintering by raising the temperature via the α-to-γ transformation point to a temperature in the γ-phase range. The sintering in the γ-phase temperature range is very effective for the growth of crystals and also for the formation of voids into a spherical shape. In addition, it is also effective for the improvement of the sintered density ratio. These effects can each improve magnetic properties. Crystal growth takes place as mentioned above. Since the diffusion velocity of atoms in the matrix of an Fe-Co alloy at a temperature in the γ-phase range is sufficiently high, it is possible to easily form minute voids—which are formed when a fine powder like the material useful in this invention is employed—into a spherical shape and moreover even to eliminate a part of the voids. The preferred temperature for the γ-phase sintering is at least 1000° C., while the holding time is 10–120 min. Incidentally, temperatures lower than 1000° C. cannot induce any sufficient diffusion and crystal growth.

No particular limitation is imposed on the atmosphere to be employed for the sintering according to the second aspect of this invention. It can be conducted in a reduced-pressure atmosphere, a reduction gas atmosphere, an inert gas atmosphere, a non-oxidizing atmosphere or the like. It is however desirable to conduct it in a reduction gas atmosphere. It is particularly preferred for the reduction of C and O as impurities to conduct the sintering in a hydrogen atmosphere whose dew point has been controlled. The above-described sintering temperature and holding time of this invention are merely illustrative of preferred embodiments and must not be taken as limiting the practice of this invention thereto. For example, this invention embraces a process in which α-phase sintering is carried out after conducting sintering in a γ-phase temperature range to a degree not impairing α-phase sintering, in other words, for a very short time such that no substantial crystal growth takes place.

The sintered material of this invention can be economically produced by choosing the raw material powder and controlling the sintering temperature as described above.

The sintered material of the Fe-Co type according to the fifth aspect of this invention will next be described.

The sintered material of this invention is characterized by the following composition:

Co: 15–60 wt. %
O : 0.04 wt. % max.
C : 0.02 wt. % max.
Fe: remainder (including imperative impurities) and also by:
sintered density ratio: 95% min.
average crystal grain size: 50 μm min.

First of all, reasons for the above limitation of the final composition of the sintered material will be described.

Co: 15–60 wt. %

Substitution of Co for Fe is effective for improving the saturated magnetic flux density (Bs). However, any Co proportions smaller than 15 wt. % or greater than 60 wt. % cannot draw out the effects of Co fully. The proportion of Co has therefore been limited to 15–60 wt. %.

C: 0.02 wt. % max., O: 0.04 wt. % max

C and O adversely affect magnetic properties, especially, coercive force (Hc) and maximum magnetic permeability ($\mu_{max}$). As shown in Table 1, good Hc and $\mu_{max}$ can be obtained by controlling the proportions of C and O to 0.02 wt. % max. and 0.04 wt. % max., respectively. Accordingly, the proportions of C and O were limited to 0.02 wt. % max. and 0.04 wt. % max. (C proportion ≦ 0.02 wt. %, O proportion ≦ 0.04%), respectively to improve the magnetic flux density in a low magnetic field. Incidentally, the proportions of C and O can be controlled by adjusting the sintering atmosphere.

Sintered density ratio: 95% min

Sintered density ratio is a critical characteristic value, which directly governs the Bs of a sintered body and also affects its Hc and $\mu_{max}$. Table 2 shows measurement results of magnetic properties of sintered materials whose chemical compositions were substantially the same but whose sintered density ratios were changed by using raw material powders of different particle sizes.

It is understood from the measurement results that sintered density ratios smaller than 95% cannot improve the magnetic flux density in a low magnetic field. Accordingly, the sintered density ratio has been limited to 95% min.

Average crystal grain size: 50 μm min

Crystal grain size affects the energy required for the reversal of magnetic domains, so that it also affects Hc and $\mu_{max}$. Smaller crystal grain sizes deteriorate both Hc and $\mu_{max}$. Average crystal grain sizes smaller than 50 μm cannot assure magnetic properties comparable with those of ingots in a low magnetic field. The average crystal grain size is therefore limited to 50 μm min. When the average grain size increases, Hc and $\mu_{max}$ are both improved and as a result, the magnetic properties in a low magnetic field are also improved. If the average crystal grain size however exceeds 500μm, the effects of improving the magnetic properties in a low magnetic field become smaller and the sintered body develops cracks more easily. It is therefore not preferred to make the crystal grain size unduly large.

TABLE 1

| | (wt %) | | Magnetic properties | | | |
|---|---|---|---|---|---|---|
| No. | C | O | B80 (KG) | B20 (KG) | Hc (Oe) | μmax |
| 1 | 0.005 | 0.010 | 23.5 | 22.5 | 0.9 | 10500 |
| 2 | 0.005 | 0.015 | 23.3 | 22.4 | 1.0 | 9800 |
| 3 | 0.007 | 0.022 | 23.3 | 22.3 | 1.1 | 8700 |
| 4 | 0.016 | 0.017 | 23.4 | 22.1 | 1.3 | 7000 |
| 5 | 0.017 | 0.035 | 23.3 | 22.0 | 1.5 | 5500 |
| 6 | 0.046 | 0.019 | 23.2 | 21.7 | 1.7 | 3800 |
| 7 | 0.015 | 0.074 | 23.1 | 21.5 | 1.8 | 3700 |

Note:
1. Chemical composition, Fe: 51.3 ± 0.1 (wt %) Co: 48.6 ± 0.1 (wt %)
2. Sintered density ratio: 98 ± 0.3 (%)
3. Average crystal grain size: 300 ± 100 μm when subjected to pressure-assisted sintering and can therefore bring about rather high density ratios compared to powders having an average particle size smaller than 10 μm.

On the other hand, average particle sizes greater than 25 μm can by no means achieve any density ratio of 95% or higher so that the sintered material of this invention cannot be obtained. Therefore, the upper limit of average particle size has been limited to 25 μm. Further, powders having an average particle size smaller than 3 μm are costly and uneconomical. They are hence excluded.

Sintering conditions will next be described.

The first stage of the sintering has to be conducted in a hydrogen-containing gas or reduced-pressure atmosphere, which is a reduction gas atmosphere. The term "reduced-pressure atmosphere" as used herein means an

TABLE 2

| No. | Raw material powder | Sintered density ratio (%) | $B_{80}$ (kG) | $B_{20}$ (kG) | Hc (Oe) | μmax |
|---|---|---|---|---|---|---|
| 9 | Atomized Fe—Co powder (6.7 μm) | 98 | 23.3 | 22.6 | 0.7 | 11500 |
| 10 | Atomized Fe—Co powder (9.7 μm) | 95 | 22.6 | 22.1 | 1.4 | 7100 |
| 11 | Carbonyl Fe powder (3.5 μm) + Atomized Co powder (9.3 μm) | 98 | 23.4 | 22.2 | 0.9 | 8400 |
| 12 | Carbonyl Fe powder (5.5 μm) + Reduced Co powder (6.3 μm) | 98 | 23.3 | 22.3 | 1.1 | 8800 |
| 13 | Atomized Fe powder (14. μm) + Reduced Co powder (5.2 μm) | 95 | 22.5 | 22.0 | 1.5 | 6800 |
| 14 | Atomized Fe-20% Co powder (5.7 μm) + Reduced Co powder(6.3 μm) → Average particle size of mixed powder was 5.9 μm. | 98 | 23.3 | 22.4 | 0.8 | 9100 |
| 15 | Atomized Fe-80% Co powder (7.7 μm) + Carbonyl Fe powder (4.5 μm) → Average particle size of mixed powder was 6.2 μm. | 97 | 23.0 | 22.3 | 1.2 | 7800 |
| 16 | Atomized Fe—Co powder (10.7 μm) | 94 | 22.2 | 21.2 | 1.8 | 3500 |
| 17 | Atomized Fe powder (16.1 μm) + Reduced Co powder (6.3 μm) | 94 | 22.2 | 21.0 | 2.1 | 3300 |
| 18 | Carbonyl Fe powder (5.3 μm) + Atomized Co powder (11.7 μm) | 93 | 21.8 | 20.7 | 2.6 | 2200 |

Note:
1. Chemical composition, Fe: 51.1 ± 0.1 (wt %), Co: 48.8 ± 0.1 (wt %), C: 0.003–0.005 (wt %), O: 0.007–0.010 (wt %)
2. α-phase sintering in hydrogen (dew point: +30° C.) and γ-phase sintering in hydrogen (dew point: −20° C.).
3. Average crystal grain size: 350 ± 100 μm
4. Figures in parentheses indicate average particle sizes.

Next, the production process according to the third aspect of this invention will be described.

The present inventors have found that the average particle size of a raw material powder affects the sintered density and any average particle sizes greater than a certain upper limit of particle size cannot provide a sintered material of this invention.

Although the particle size of a raw material powder varies depending on the sintering method, the average particle size should range from 3 μm to 25 μm. Firstly, in the case of sintering by usual heating alone, an average particle size of 3–9 μm is preferred. When pressure-assisted sintering using in combination heating and pressurization by a gas pressure is applied, 10–25 μm is preferred. When sintering is conducted by heating alone, the sintered density ratio decreases as the average particle size increases. Particle sizes greater than 9 μm cannot achieve the sintered density ratio of 95%. Further, particle sizes greater than 25 μm cannot attain the sintered density ratio of 90%.

When the sintered-density ratio-exceeds 90%, pores of the sintered body are closed so that the sintered density ratio can be increased to 95% or higher by pressure-assisted sintering.

Further, average particle sizes of 10 μm and greater lead to significant improvements in the density ratio atmosphere which is obtained by evacuating a highly-hermetic heating furnace with a vacuum pump and optionally causing a small amount of a non-oxidizing gas to flow through the furnace at the same time as the evacuation. The furnace pressure is required to be 0.05 Torr or less in the former case or 30 Torr or less in the latter case. Otherwise, the reactions between the oxides on the surfaces of the raw material powder and carbon derived from the remaining binder do not proceed sufficiently, thereby failing to obtain a sintered body of a high purity. The reduced-pressure atmosphere will now be described in further detail. It is the sum of the partial pressures (hereinafter abbreviated as a "product gas pressure") of CO and $CO_2$ gases, which are reaction products, that governs the reduction reactions between the oxides and carbon. It is thus an essential requirement to discharge the reaction gases out of the reaction system (out of the sintering furnace) in order to always maintain the product gas pressure at a level lower than the oxidation/reduction equilibrium pressures. As a method for meeting this requirement, it is possible to use a reduced-pressure atmosphere, a high-purity non-oxidizing gas such as Ar or $N_2$, or both a reduced-pressure atmosphere and high-purity non-oxidizing gas. The first method can be conducted in a vacuum sintering furnace constructed of a heating furnace, which has high hermetic property so that the product gas pressure becomes substantially equal to the total pressure in the sintering furnace, and equipped with a vacuum pump having pumping speed sufficient to maintain the total pressure of the furnace at 0.05 Torr or lower. The second method is conducted while maintaining the pressure of the furnace within the range of the atmospheric pressure. To control the product gas pressure at 0.05 Torr or lower, it is necessary to maintain a fresh high-purity gas free of the product gases at 759.95 Torr or higher as far as a simple calculation is concerned. It is however industrially impossible to feed a non-oxidizing gas in an amount as much as about 10,000 times the product gases. This method cannot therefore be considered to be preferable. In the third method, a fresh high-purity non-oxidizing gas free of the reaction product gases is introduced through a pressure control valve into the vacuum sintering furnace referred to above with respect to the first method. This method is said to be somewhat effective for the inhibition of evaporation of volatile metal elements upon heating. The total pressure of the furnace may preferably be 30 Torr or lower. In this method, the total pressure of the furnace is expressed by the sum of the reaction product gas and the pressure of the non-oxidizing gas introduced. As long as the pumping speed of the vacuum pump remains constant, the pumping speed of the product gas out of the heating furnace remains constant whether the non-oxidizing gas is introduced or not. If the total pressure of the furnace exceeds 30 Torr, the pumping speed of the vacuum pump (especially where a mechanical booster and an oil-sealed rotary vacuum pump are combined) is lowered abruptly and the velocity of release of the reaction product gases from the surfaces of the sintered body is also reduced. The pumping speed of the product gases drops and as a result, the velocities of the reduction reactions are lowered. The upper limit of the total pressure of the furnace is therefore set at 30 Torr. It is also necessary to control the sintering temperature at 1000°-1300° C. If the sintering temperature becomes lower than the lower limit, the impurity elimination reaction between the atmosphere and raw material powder does not proceed effectively. If it exceeds the upper limit, the sintering of the powder itself proceeds faster than the impurity elimination reaction so that impurities cannot be removed. Since these impurities are removed as water vapor or carbon dioxide gas, the loss of gas flow pores leads to a serious problem. In particular, the green body is formed of fine powder and gas flow pores are inherently small. A special care should therefore be exercised. In addition, the progress of the sintering begins to accelerate at these temperatures and the sintering temperature varies depending on the particle size of the raw material powder. It is therefore preferable to choose a lower temperature from the sintering temperature range of this invention where the average particle size is small or a higher temperature from the range where the average particle size is large.

The sintering time is the time which is required until the proportions of C and O reach their respective equilibrium values at the sintering temperature employed. In general, it ranges from 20 minutes to 4 hours. It can be easily determined by several trial experiments.

Next, the second stage of the sintering of this invention will be described.

The second-stage sintering is conducted to densify the sintered body which has been densified and pore-closed by the first-stage sintering. It is therefore no longer required to use any reactive gas. Therefore, the atmosphere gas is limited to an inert gas such as nitrogen or argon. On the other hand, the temperature has to be controlled at a level at least 50° C. higher than the sintering temperature of the first-stage sintering.

The lower limit of the sintering temperature is set at a level at least 50° C. higher than the sintering temperature of the first-stage sintering, because the sintering temperature of the first stage is set at a temperature where the sintering speed begins to accelerate and the densification by the first-stage sintering is thus insufficient. When a reduced-pressure atmosphere is used in the first stage, differences in composition occur in the surface of the sintered body due to the differences in vapor pressure among the constituent elements. Even when a reduction gas atmosphere is used, a difference in composition takes place between the surface of the sintered body or powder exposed to the gas and the interior thereof.

This distribution of composition occurs in the rate-determining step of atomic diffusion in the sintered body. It is therefore necessary to have the homogenization treatment proceed promptly at a temperature at least 50° C. higher than the sintering temperature of the first stage, namely, in a temperature range of higher diffusion velocities in an atmosphere of at least the atmospheric pressure, in which the constituent elements do not evaporate, or in an atmosphere in which no chemical reaction takes place at all.

The upper limit of the sintering temperature is the temperature at which the crystal grain size starts coarsening beyond necessity or melting begins. A more preferable temperature range is 1200-°1400° C.

The sintering time of the second stage is the time which is required until the sintered density and chemical composition distribution reach equilibrium values at the sintering temperature employed. In general, it ranges from 20 minutes to 2 hours. It can be easily chosen by several trial experiments.

By limiting the sintering method as described above, sintered Fe-Co-V type materials having high magnetic properties can be produced economically by using the injection molding process.

The starting raw material powders which make up the raw material powders of this invention can be selected from Fe, Co and Fe-Co powders, which have been described above, and likewise from an atomized Fe-Co-V powder, an atomized Fe-V powder, an atomized Co-V powder, a ground Fe-V powder, etc. Regarding the purity of the raw material powder, it is sufficient if the proportions of impurities other than C, O and N, which can be eliminated in the course of sintering, are so low that they can be ignored practically. In general, powders containing Fe, Co and V in a total proportion of 97-99 wt. % can be used.

The raw material powder is then blended with a binder into a compound. The compound is molded by injection molding, followed by a debinding treatment.

After the debinding treatment, sintering is conducted as described above in order to achieve densification and reduction of the C and O contents.

Furthermore, the C and O contents of the final sintered body may be controlled as needed. As a method for controlling the C and O contents, may be mentioned to increase or decrease the C/O ratio of the debound body. The C content can be lowered by making the C/O ratio smaller, while the O content can be reduced by making the C/O ratio greater. This control of the C/O ratio can be achieved, for example, by adjusting the contents of C and O in the raw material powder, by adjusting the degree of removal of the binder, or by applying an oxidation treatment subsequent to the removal of the binder. Lowering of the total level of the contents of C and O, said total level being equal to the product of the C content and the O content, can be effected by modifying the sintering atmosphere of the first stage. This can be achieved by lowering the pressure when a reduced-pressure atmosphere is used or by improving the purity of the atmosphere gas when a reduction gas atmosphere is employed.

A description will next be made of the sintered material of the Fe-Co-V type according to the sixth aspect of this invention.

The sintered material of this invention is characterized by the following composition:

Co: 15–60 wt. %
V : 0.5–3.5 wt. %
O : 0.6 wt. % max.
Fe: remainder (including imperative impurities) and also by:
sintered density ratio: 95% min.
average crystal grain size: 50 μm min.

Reasons for the above limitation of the final composition of the sintered material will be described.

Co: 15–60 wt. %

Substitution of Co for Fe is effective for improving the saturated magnetic flux density (Bs). However, any Co proportions smaller than 15 wt. % or greater than 60 wt. % cannot draw out the effects of Co fully. The proportion of Co has therefore been limited to 15–60 wt. %.

V: 0.5–3.5 wt. %

V contributes to an improvement in the electrical resistivity of an Fe-Co alloy. However, any V proportions smaller than 0.5 wt. % are too small to effectively improve the electric resistivity. Any V proportions greater than 3.5 wt. % however result in semi-hard magnetism.

O: 0.6 wt. % max., C: 0.04 wt. % max.

C and O adversely affect magnetic properties, especially, coercive force (Hc) and maximum magnetic permeability ($\mu_{max}$).

However, when a highly oxidative element like V is contained, it is practically impossible to lower the content of O derived from the raw material powder and the content of C derived from the organic binder to provide the injection-molding material at the same time in the sintering atmosphere. Therefore, the primary object was placed on the reduction of the content of C which gives particularly adverse influence to the magnetic properties. In this aspect, the content of C is reduced by daringly increasing the content of O which gives smaller deleterious effects to the magnetic properties. Namely, the upper limit of the C content has been set at 0.04 wt. % because any C proportions greater than 0.04 wt. % lead to considerable deteriorations of the magnetic properties.

On the other hand, the magnetic properties are significantly deteriorated if the proportion of O exceeds 0.6 wt. %. The upper limit of the O content has therefore been set at 0.6 wt. %.

Sintered density ratio: 95% min.

Magnetic flux density is proportional to sintered density ratio. If sintered density ratio becomes smaller than 95%, the magnetic flux density is reduced so much that the characteristic features of the present alloy system (Fe-Co type) are lost.

Accordingly, the lower limit of the sintered density ratio was set at 95%. By limiting it as mentioned above, sintered Fe-Co type materials of this invention having excellent magnetic properties can be obtained for the first time.

Further, the production process according to the fourth aspect of this invention will next be described.

The average particle size of each raw material powder affects the sintered density and if the particle size exceeds a certain upper limit, sintered materials of this invention can no longer be obtained. When an Fe powder, Co powder, and a Cr and/or Cr oxide powder are used as raw material powders, it is impossible to obtain a sintered density ratio of 95% or higher and hence a sintered material of this invention if the average particle size of the Fe powder exceeds 15 μm, the average particle size of the Co powder exceeds 10 μm or the average particle size of the Cr and/or Cr oxide powder becomes greater than 30 fμm. When Fe-Co and Fe-Cr alloy powders are used, sintered density ratios of 95% or greater cannot be obtained if their average particle sizes exceed 10 μm and 30 μm, respectively.

On the other hand, if the average particle sizes of the Fe powder, Co powder, Cr powder, Cr oxide powder, Fe-Co alloy powder and Fe-Cr alloy powder become smaller than 2 μm, 1 μm, 1 μm, 1 μm, 3 μm, and 2 μm, respectively, the magnetic properties cannot be improved to any significant extent but the prices of the powders increase significantly. It is therefore not economical to use such fine powders.

Sintering conditions will next be described.

It is necessary to conduct the sintering by two-stage step.

The first stage of the sintering has to be conducted in a hydrogen-containing gas or reduced-pressure atmosphere, which is a reduction gas atmosphere. The term "reduced-pressure atmosphere" as used herein means an atmosphere which is obtained by evacuating a highly-hermetic heating furnace with a vacuum pump and optionally causing a small amount of a non-oxidizing gas to flow through the furnace at the same time as the evacuation. The furnace pressure is required to be 0.1 Torr or less in the former case or 30 Torr or less in the latter case. Otherwise, the reactions between the oxides on the surfaces of the raw material powder and carbon derived from the remaining binder do not proceed sufficiently, thereby failing to obtain a sintered body of a high purity. Matters relating to this reduced-pressure atmosphere are similar to those described above with respect to the Fe-Co-V composition. However, Cr is less oxidative than V so that the product gas pressure may be acceptable up to 0.1 Torr. As a consequence, the furnace pressure may be 0.1 Torr or lower when no non-oxidizing gas is caused to flow.

It is also necessary to control the sintering temperature at 1000°–1350° C. If the sintering temperature becomes lower than the lower limit, the impurity elimination reaction between the atmosphere and raw material powder does not proceed effectively and no sufficient sintered density can be obtained. If it exceeds the upper limit, the sintering of the powder itself proceeds faster than the impurity elimination reaction so that impurities cannot be removed. Further, Cr is caused to evaporate so that the Cr content in the surface is lowered. Since these impurities are removed as water vapor or carbon dioxide gas, the loss of gas flow pores leads to a serious problem. In particular, the green body is formed of fine powder and gas flow pores are inherently small. A special care should therefore be exercised. In addition, the progress of the sintering begins to accelerate at these temperatures and the sintering temperature varies depending on the particle size of the raw material powder. It is therefore preferable to choose a higher temperature from the sintering temperature range of this invention where the average particle size is small or a lower temperature from the range where the average particle size is large.

The sintering time is the time which is required until the proportions of C and O reach their respective equilibrium values at the sintering temperature employed. In general, it ranges from 20 minutes to 4 hours. It can be easily determined by several trial experiments.

Next, the second stage of the sintering of this invention will be described.

The second-stage sintering is conducted to densify the sintered body which has been densified and pore-closed by the preceding sintering. It is therefore no longer required to use any reactive gas. Therefore, the atmosphere gas is limited to a non-oxidizing gas such as hydrogen gas, nitrogen gas or argon gas. On the other hand, the processing temperature has to be controlled at a level at least 50° C. higher than the sintering temperature.

The lower limit of the sintering temperature is set at a level at least 50° C. higher than the sintering temperature of the first-stage sintering, because the sintering temperature of the first stage is set at a temperature where the sintering speed begins to accelerate and the densification by the first-stage sintering is thus insufficient. When a reduced-pressure atmosphere is used in the first stage, differences in composition occur in the surface of the sintered body due to the differences in vapor pressure among the constituent elements. Even when a reducing gas atmosphere is used, a difference in composition takes place between the surface of the sintered body or powder exposed to the gas and the interior thereof. This distribution of composition occurs in the rate-determining step of atomic diffusion in the sintered body. It is therefore necessary to have the homogenization treatment proceed promptly at a temperature at least 50° C. higher than the sintering temperature of the first stage, namely, in a temperature range of higher diffusion velocities in an atmosphere of at least the atmospheric pressure, in which the constituent elements do not evaporate, or in an atmosphere in which no chemical reaction takes place at all.

The upper limit of the sintering temperature is the temperature at which the crystal grain size starts coarsening beyond necessity or melting begins. A more preferable temperature range is 1200°–1350° C.

The sintering time is the time which is required until the sintered density and chemical composition distribution reach equilibrium at the sintering temperature employed. In general, it ranges from 20 minutes to 2 hours. It can be easily chosen by several trial experiments.

By limiting the sintering method as described above, sintered Fe-Co-Cr type materials having high magnetic properties can be produced economically for the first time by using the injection molding process.

The starting raw material powders which make up the raw material powders of this invention can be selected from Fe, Co and Fe-Co powders, which have been described above under [1]. Likewise, an atomized Fe-Co-Cr powder or the like can be chosen as a source for iron, cobalt and chromium. Regarding the purity of the starting raw material powder, it is sufficient if the proportions of impurities other than C, O and N, which can be eliminated in the course of sintering, are so low that they can be ignored practically. In general, powders containing Fe, Co and Cr in a total proportion of 97–99 wt. % can be used.

After molding, the resultant green body is subjected to a debinding treatment to remove the binder. This can be effected by heating the green body at a constant rate and holding it at the thus-heated temperature in a non-oxidizing atmosphere. It is desired to raise the temperature at a rate of 5°–100° C./hr because unduly high heating rates tend to result in the development of cracks and bulges in the final product. Further, oxidation of Cr takes place and magnetic properties are impaired, unless a non-oxidizing atmosphere is used.

After the debinding treatment, sintering is conducted as described above in order to achieve densification and reduction of the C and O contents.

Furthermore, the C and O contents of the final sintered body may be controlled as needed. As a method for controlling the C and O contents, the same method as already described above can be used.

A description will next be made of the sintered material of the Fe-Co-Cr type according to the seventh aspect of this invention.

The sintered material of this invention is characterized by the following composition:

Co: 20–50 wt. %
Cr: 0.5–3.5 wt. %
O : 0.04 wt. % max.
C : 0.02 wt. % max.
Fe: remainder (including imperative impurities) and also by:
sintered density ratio: 95% min.
average crystal grain size: 50 μm min.

Reasons for the above limitation of the final composition of the sintered material will be described.

Co: 20–50 wt. %

Substitution of Co for Fe is effective for improving the saturated magnetic flux density (Bs). However, any Co proportions smaller than 20 wt. % or greater than 50 wt. % cannot draw out the effects of Co fully. The proportion of Co has therefore been limited to 20–50 wt. %.

Co: 0.02 wt. % max., 0: 0.04 wt. % max

C and O adversely affect magnetic properties, especially, coercive force (Hsc) and maximum magnetic permeability ($\mu_{max}$). lower and 0.04 wts. % or lower, respectively, good Hc and $\mu_{max}$ can be obtained. Therefore, the proportions of C and O have been limited to 0.02 wt. % max. and 0.04 wt. % max (C $\leqq$ 0.02 wt. %, O $\leqq$ 0.04 wt. %), respectively. Incidentally, the contents of C and O can be controlled by adjusting the sintering atmosphere.

Cr: 0.5–3.5 wt. %

Cr is very effective for increasing electrical resistivity and decreasing iron loss (W). However, any Cr proportions smaller than 0.5 wt. % are too small to draw out its effectiveness fully. On the other hand, any Cr proportions greater than 3.5 wt. % cannot bring about substantial additional effects.

Sintered density ratio is a critical characteristic value, which directly governs the Bs of a sintered body and also affects its Hc and $\mu_{max}$. As already demonstrated in Table 2, magnetic properties of sintered materials whose chemical compositions were substantially the same but whose sintered density ratios were changed by using raw material powders of different particle sizes were measured. As a result, it has been found that sintered density ratios smaller than 95% cannot improve the magnetic flux density in a low magnetic field. Accordingly, the requirement for sintered density ratio is the same for both sintered material of the Fe-Co type and those the Fe-Co-Cr type.

Average crystal grain size: 50 μm min

Crystal grain size affects the energy required for the reversal of magnetic domains, so that it also affects Hc and $\mu_{max}$. Smaller crystal grain sizes deteriorate both Hc and $\mu_{max}$. Average crystal grain sizes smaller than 50 μm cannot assure magnetic properties comparable with those of ingots in a low magnetic field. The average crystal grain size is therefore limited to 50 μm min.

When the average grain size increases, Hc and μmax are both improved and as a result, the magnetic properties in a low magnetic field are also improved. If the average crystal grain size however exceeds 500 μm, the effects of improving the magnetic properties in a low magnetic field become smaller and the sintered body develops cracks more easily. It is therefore not preferred to make the crystal grain size unduly large.

EXAMPLES

The present invention will be described more specifically by the following examples. It should however be born in mind that the present invention is not limited to the following examples.

EXAMPLE 1

As raw material powders, were employed an atomized Fe-50% Co powder (Raw Material Powder A), an Fe-35% Co mixed powder (Raw Material Powder B) composed of a carbonyl Fe powder (Constituent Powder b1) and a reduced Co powder (Constituent Powder B2), and an Fe-50% Co mixed powder (Raw Material Powder C) also composed of Constituent Powders b1 and b2, and 1:1 mixed powder (Raw Material Powder D) of Raw Material Powder A and Raw Material Powder C. The compositions and average particle sizes of the raw material powders and constituent powders are summarized in Table 3. Using a pressure kneader, 49 vol.% of a wax-type binder was added to each of these raw material powders. After separately kneading the resultant mixtures, they were separately ground by a grinder into particulate injection-molding raw materials having a diameter of about 3 mm. Then, using an injection molding machine, the raw materials were separately molded at an injection temperature of 150° C. into ring-shaped bodies having an outer diameter of 53 mm, an inner diameter of 41 mm and a height of 4.7 mm. The injection-molded green bodies were then subjected to a debinding treatment by heating them at 7.5° C./hr to 600° C. and holding them at that temperature for 30 minutes in nitrogen. Thereafter, in hydrogen, they were heated at 5° C./min and were held at 700° C. for 1 hour, at 950° C. for 1 hour and then at 1250° C. for 2 hours, whereby they were sintered. The atmosphere was controlled to have a dew point of +30° C. until the end of the holding at 950° C., and thereafter another dew point of −20° C. or lower. The sintered bodies thus obtained were measured by the underwater weight measuring method, so that their density ratios were determined. Furthermore, samples produced under the same conditions were applied with windings and their magnetic properties were determined by an automatic flux measuring and recording instrument. Properties of the sintered bodies are shown in Table 4. For the sake of comparison, an Fe-50% Co mixed powder (Conventional Powder 1) composed of an atomized Fe-20% Co powder (Constituent Powder e) and the reduced Co powder (Constituent Powder b2) was provided as a raw material powder. The compositions and average particle sizes of Constituent Powder e and Conventional Powder 1 are also shown in Table 3. Conventional Powder 1 was added and mixed with 1 wt. % of zinc stearate and was then compression-formed under a pressure of 4 tons/cm$^2$ into rings having an outer diameter of 53 mm, an inner diameter of 41 mm and a height of 4.7 mm. Next, the rings were held at 600° C. for 0.5 hour in a hydrogen atmosphere, thereby conducting their debinding. They were thereafter held at 750° C. for 1 hour, so that they were presintered. After conducting compression forming again under a pressure of 7 tons/cm$^2$, they were held at 1350° C for 1 hour in a hydrogen atmosphere to obtain comparative sintered bodies (Comparative Example 1-1). Further, some of the sintered bodies were heated to 1250° C. in argon of 1 atm. After increasing the pressure of Ar gas to 1200 atm, they were held for 1 hour to conduct a pre-heated HIP treatment. The resultant sintered bodies were also used as comparative sintered bodies (Comparative Example 1-2). Their properties were measured in a similar manner as in the above example. The results are shown in Table 4.

It has been clearly found from the table that the sintered Fe-Co type materials of this invention had superior magnetic properties to the conventional sintered materials.

TABLE 3

| | Production process of powder | Chemical analysis date (wt. %) | | | | | Average particle size (μm) |
|---|---|---|---|---|---|---|---|
| | | Fe | Co | C | O | N | |
| Raw Material Powder A | Atomizing Process | 49.9 | 49.1 | 0.05 | 0.7 | 0.003 | 4.5 |
| Raw Material Powder B | Mixing Process | 64.5 | 33.8 | 0.5 | 0.3 | 0.7 | 5.7 |
| Raw Material Powder C | Mixing Process | 49.6 | 48.6 | 0.6 | 0.4 | 0.6 | 6.2 |
| Raw Material Powder D | Mixing Process | 50.5 | 49.3 | 0.3 | 0.5 | 0.3 | 5.8 |
| Constituent Powder b1 | Carbonyl Process | 97.4 | — | 1.0 | 0.3 | 1.1 | 4.7 |
| Constituent Powder b2 | Reduction Process | — | 99.3 | 0.03 | 0.5 | 0.005 | 6.4 |
| Constituent Powder 1 | Mixing Process | 49.9 | 49.3 | 0.05 | 0.4 | 0.005 | 24.7 |

TABLE 3-continued

| | Production process of powder | Chemical analysis date (wt. %) Fe | Co | C | O | N | Average particle size (μm) |
|---|---|---|---|---|---|---|---|
| Constituent Powder e | Atomizing Process | 79.0 | 20.3 | 0.05 | 0.4 | 0.005 | 28.3 |

Note: The average particle sizes indicate volume average particle sizes measured by the microtracking technique.

TABLE 4

| | | Sintered density ratio (%) | Average crystal grain size (μm) | Chemical analysis data (wt %) Fe | Co | C | O | Magnetic properties B 80 (KG) | B 20 (KG) | Hc (Oe) | μmax |
|---|---|---|---|---|---|---|---|---|---|---|---|
| Example 1-1 | Raw Material Powder A | 97 | 200 | 50.2 | 49.6 | 0.010 | 0.025 | 22.9 | 22.3 | 1.1 | 8800 |
| Example 1-2 | Raw Material Powder B | 97 | 300 | 66.5 | 33.4 | 0.004 | 0.010 | 22.7 | 20.1 | 1.8 | 4200 |
| Example 1-3 | Raw Material Powder C | 98 | 350 | 51.2 | 48.7 | 0.005 | 0.012 | 23.4 | 22.5 | 0.9 | 9500 |
| Example 1-4 | Raw Material Powder D | 97 | 300 | 50.7 | 49.3 | 0.008 | 0.019 | 23.2 | 22.3 | 1.0 | 8700 |
| Comparative Example 1-1 | Conventional sintered material | 95 | — | 50 | 50 | — | — | B50:21.8 | | 2.3 | 2500 |
| Comparative Example 1-2 | Conventional sintered material (HIP product) | 99 | — | 50 | 50 | — | — | B50:21.3 | | 2.4 | 1700 |

EXAMPLE 2

Debound bodies were prepared by conducting kneading, injection molding and debinding in exactly the same manner as in Example 1 except that Raw Material Powder B was used and the amount of the binder added was changed to 50 vol. %. They were sintered under their corresponding conditions shown in Table 5, thereby obtaining sintered bodies having different crystal grain sizes. Properties of the sintered bodies were measured ion a similar manner to Example 1. The results are also shown in Table 5. It is envisaged from Table 5 that soft magnetism is reduced abruptly when the crystal grain size becomes smaller than 50 μm. Although high properties are obtained by γ-phase sintering only, it is also understood that high properties can still be obtained even at a γ-phase sintering temperature as low as 1000° C. so long as the process of sintering in the γ phase subsequent to presintering in the α phase is employed (compare Example 2-2) to Example 2-5). Further, the process relying upon sintering in the γ phase only (Example 2-5) can also obtain high properties compared with the conventional process, in which the raw material is shaped in a mold and then sintered, even when uneconomical high temperature or uneconomical high temperature and high pressure are not used. When only 60 -phase sintering is conducted (Comparative Example 2-4), the average crystal grain size is as low as 15 μm and the degree of its improvement is not sufficient although higher density and magnetic properties are obtained compared to the conventional process.

Example 3

The raw material powders shown in Table 5 were individually added with their corresponding binders also given in Table 5. After separately kneading the resultant mixtures, they individually were ground to prepare injection-molding compounds. By an injection molding machine, the compounds were then molded into ring-shaped green test pieces having an outer diameter of 53 mm, inner diameter of 41 mm and a height of 5 mm.

In nitrogen, the green test pieces were heated at +5° C./hr to 600° C. and then held at 600° C. for 30 minutes, thereby subjecting them to a debinding treatment. Thereafter, the debound test pieces were subjected to a first-stage heat treatment and a second-stage heat treatment under respective conditions shown in Table 5. The chemical composition, density ratios, magnetic properties and electrical resistivities of the thus-obtained sintered bodies are also shown in Table 5.

Incidentally, the test pieces of Nos. 3-1 to 3-7 in Table 5 were heated at 350°–650° C. in a hydrogen gas atmosphere having a dew point of 0° C. after the debinding. Their C and O contents were adjusted by changing the heating temperature. Thereafter, the test pieces were subjected to the first-stage and second-stage heat treatments.

It is understood from Table 5 that the magnetic properties were deteriorated when the proportions of C and O exceeded 0.04 wt. % and 0.6 wt. %, respectively, in Nos. 3-1 to 3-7 (Comparative Examples 1 and 3). When the proportion of O was unduly small (Comparative Example 2), it was unable to reduce the proportion of C so that the magnetic properties were deteriorated extremely. However, excellent magnetic properties were obtained when the proportions of C and O were within their respective ranges specified in the present invention (Invention Examples 1–6).

When the heat treatment temperature of the first stage was too high (Comparative Example 6) or too low (Comparative Example 5) compared with the temperature range of this invention, the C proportion was higher than the range of this invention in both examples so that the magnetic properties were deteriorated.

When the heat treatment temperature of the second stage was not higher by at least 50° C. than the heating temperature of the first stage (Comparative Example 4), the low density was only obtained so that excellent magnetic properties were not obtained.

TABLE 5

| No. | Raw material powder: Constituent powders. Figures in parentheses are average particle sizes (μm) | Average particle size (μm) | Binder. Figures in parentheses are amounts added (wt. %) | First-stage heat treatment: Atmosphere | First-stage heat treatment: Temperature (°C.) | Second-stage heat treatment: Atmosphere | Second-stage heat treatment: Temperature (°C.) |
|---|---|---|---|---|---|---|---|
| 3-1 | All, | 5.8 | Wax type (10) | 0.001 Torr | 1180 | 1 atm Ar | 1300 |
| 3-2 | carbonyl Fe powder | 5.8 | Wax type (10) | 0.001 Torr | 1180 | 1 atm Ar | 1300 |
| 3-3 | (5.2) + | 5.8 | Wax type (10) | 0.001 Torr | 1180 | 1 atm Ar | 1300 |
| 3-4 | reduced Co powder | 5.8 | Wax type (10) | 0.001 Torr | 1180 | 1 atm Ar | 1300 |
| 3-5 | (6.4) + | 5.8 | Wax type (10) | 0.001 Torr | 1180 | 1 atm Ar | 1300 |
| 3-6 | Fe—50% V ground | 5.8 | Wax type (10) | 0.001 Torr | 1180 | 1 atm Ar | 1300 |
| 3-7 | powder (7.5) | 5.8 | Wax type (10) | 0.001 Torr | 1180 | 1 atm Ar | 1300 |
| 3-8 | | 5.8 | Wax type (10) | 0.001 Torr | 1180 | 1 atm Ar | 1300 |
| 3-9 | | 5.8 | Wax type (10) | 0.001 Torr | 1180 | 1 atm Ar | 1300 |
| 3-10 | | 6.1 | Wax type (10) | 0.001 Torr | 1180 | 1 atm Ar | 1300 |
| 3-11 | | 5.8 | Wax type (10) | 0.001 Torr | 1180 | 1 atm Ar | 1180 |
| 3-12 | | 5.8 | Wax type (10) | $H_2$ | 1200 | $H_2$ | 1275 |
| 3-13 | | 5.8 | Resin type (10) | 0.001 Torr | 1130 | 1 atm Ar | 1350 |
| 3-14 | Atomized Fe—Co—V powder | 8.8 | Resin type (9) | 0.001 Torr | 950 | 1 atm Ar | 1350 |
| 3-15 | Atomized Fe—Co—V powder | 8.8 | Resin type (9) | 0.001 Torr | 1050 | 1 atm Ar | 1350 |
| 3-16 | Atomized Fe—Co—V powder | 8.8 | Resin type (9) | 0.001 Torr | 1250 | 1 atm Ar | 1350 |
| 3-17 | Atomized Fe—Co—V powder | 8.8 | Resin type (9) | 0.001 Torr | 1350 | 1 atm Ar | 1350 |

| No. | Chemical composition of sintered body: Co content (wt %) | V content (wt %) | O content (wt %) | C content (wt %) | Density ratio (%) | Magnetic properties: B20 (kG) | Hc (Oe) | μmax (—) | Electrical resistivity (μΩcm) | Remarks |
|---|---|---|---|---|---|---|---|---|---|---|
| 3-1 | 48.4 | 2.1 | 0.33 | 0.01 | 95.6 | 19.5 | 1.1 | 4200 | 42 | Example 1 |
| 3-2 | 48.4 | 2.1 | 0.31 | 0.02 | 95.7 | 19.3 | 1.5 | 3800 | 42 | Example 2 |
| 3-3 | 48.4 | 2.1 | 0.28 | 0.04 | 95.7 | 18.3 | 2.5 | 3000 | 44 | Example 3 |
| 3-4 | 48.4 | 2.1 | 0.29 | 0.05 | 95.7 | 17.5 | 3.7 | 1800 | 43 | Comparative Example 1 |
| 3-5 | 48.5 | 2.1 | 0.03 | 0.14 | 95.8 | 15.2 | 5.5 | 750 | 31 | Comparative Example 2 |
| 3-6 | 48.2 | 2.1 | 0.55 | 0.02 | 95.7 | 18.1 | 2.8 | 3100 | 40 | Example 4 |
| 3-7 | 48.2 | 2.1 | 0.65 | 0.02 | 95.6 | 17.5 | 3.1 | 2800 | 47 | Comparative Example 3 |
| 3-8 | 48.4 | 2.1 | 0.05 | 0.04 | 95.7 | 18.3 | 2.3 | 3200 | 34 | Example 5 |
| 3-9 | 48.4 | 2.1 | 0.10 | 0.03 | 95.7 | 19.2 | 1.6 | 3800 | 37 | Example 6 |
| 3-10 | 47.8 | 2.8 | 0.40 | 0.02 | 95.7 | 19.0 | 1.9 | 3700 | 47 | Example 7 |
| 3-11 | 48.4 | 2.1 | 0.31 | 0.02 | 92.2 | 16.2 | 2.7 | 2500 | 44 | Comparative Example 4 |
| 3-12 | 48.7 | 1.2 | 0.33 | 0.02 | 95.6 | 19.5 | 1.7 | 3500 | 25 | Example 8 |
| 3-13 | 48.1 | 2.3 | 0.37 | 0.03 | 95.9 | 18.7 | 2.3 | 3400 | 44 | Example 9 |
| 3-14 | 48.0 | 1.8 | 0.10 | 0.15 | 95.2 | 14.7 | 5.6 | 800 | 35 | Comparative Example 5 |
| 3-15 | 48.0 | 1.8 | 0.36 | 0.02 | 95.1 | 19.1 | 1.7 | 3300 | 35 | Example 10 |
| 3-16 | 48.0 | 1.8 | 0.28 | 0.02 | 95.2 | 19.2 | 1.7 | 3100 | 33 | Example 11 |
| 3-17 | 48.0 | 1.8 | 0.37 | 0.05 | 95.1 | 17.2 | 3.3 | 2000 | 36 | Comparative Example 6 |

Note: As the binders, those composed principally of a paraffin were used as the wax type binders while those composed principally of an acrylic resin were used as resin type binders.

EXAMPLE 4

Using F2 Powder, Co3 Powder and Cr2 Powder shown in Table 6, the powders of various compositions given in Table 7 were prepared. Using a pressure kneader, those raw material powders were individually added and kneaded with 49 vol. % of wax type binder which was composed principally of a paraffin. The resultant mixtures were separately ground in a grinding mill, thereby forming particulate injection-molding raw materials having a diameter of about 3 mm. Using an injection molding machine, they were separately formed at an injection temperature of 150° C. into ring-shaped green bodies having an outer diameter of 53 mm, an inner diameter of 41 mm and a height of 4.7 mm. In nitrogen gas, the injection-molded green bodies were heated at 7.5° C./hr to 600° C and then held at that temperature for 30 minutes, whereby they were subjected to a debinding treatment. Thereafter, they were held at 1150° C. for 1 hour in a vacuum of 0.06 Torr and further at 1300° C. for 2 hours in argon gas, so that they were subjected to a sintering treatment.

The sintered bodies thus obtained were individually measured by the underwater weight measuring method to determine their sintered density ratios.

Furthermore, samples produced under the same conditions were applied with windings and their magnetic properties were determined by an automatic flux measuring and recording instrument. Properties of the individual sintered bodies are summarized in Table 7.

The sintered bodies of the invention examples (Nos. 4-2 to 4-4) having a chemical composition within the range of this invention showed excellent magnetic properties and high electrical resistivities.

EXAMPLE 5

Similar experiments to Example 4 were conducted using F3 Powder, FCo3 Powder and FCr2 Powder shown in Table 6 in No. 5-1 and F4 Powder, FCo4 Powder and FCr4 Powder in the same table in No. 5-2. Chemical compositions and properties of the resultant sintered bodies are shown in Table 8. The sintered body of the invention example (No. 15), which had an average particle size and sintered density ratio within their corresponding ranges specified in this invention, exhibited excellent magnetic properties and high resistivity.

EXAMPLE 6

Similar experiments to Example 4 were conducted using F3 Powder, Co2 Powder and FCr3 Powder shown in Table 6 in No. 6-1 and F1 Powder, Co1 Powder and Cr1 Powder in the same table in No. 6-2. Chemical compositions and properties of the resultant sintered bodies are shown in Table 9. The sintered body of the invention example (No. 16), which had an average crystal grain size within the range specified in this invention, exhibited excellent magnetic properties and high resistivity.

EXAMPLE 7

Figure 2:
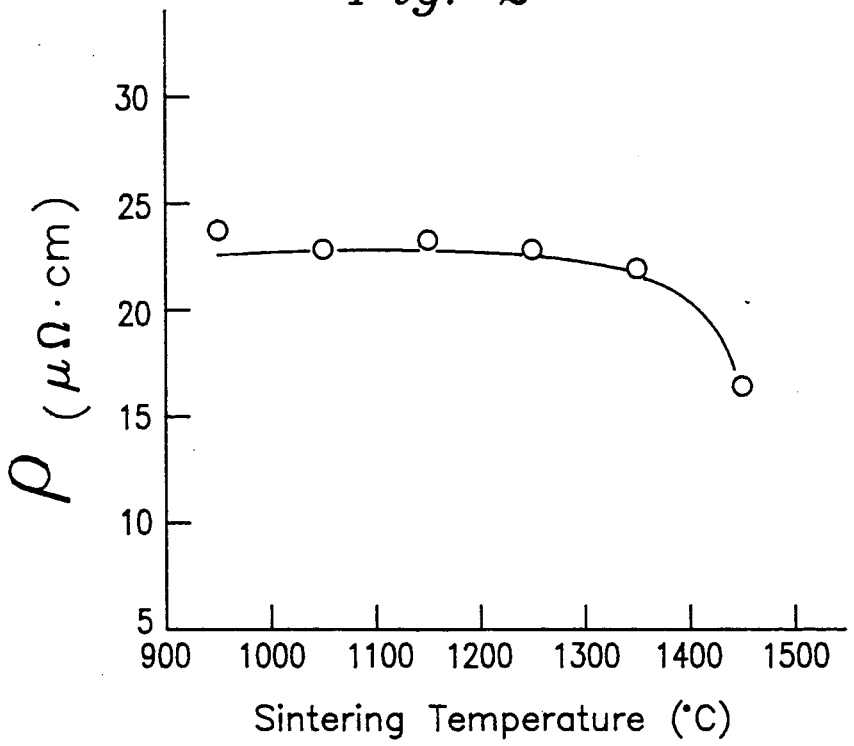
FIG. 2 is a graph showing results of Example 7 and diagrammatically depicts electrical resistivities as a function of the sintering temperature.

Similar experiments to Example 4 were conducted using F2 Powder, Cr3 Powder and FCo2 Powder shown in Table 6. However, the sintering temperature of the first stage was changed in a range of from 950° to 1400° C. Magnetic flux densities B20 and resistivities are diagrammatically shown as a function of sintering temperature in FIG. 1 and FIG. 2, respectively. Excellent properties were exhibited within the range of this invention.

Incidentally, the final composition was as follows: Co: 35.2 wt. %, Cr: 2.2 wt. %, C: 0.010 wt. %, 0: 0.013 wt. %, and Fe: balance.

TABLE 6

| Kind | | Symbol | Chemical composition (wt. %) Fe | Co | Cr | C | O | N | Average particle size (μm) |
|---|---|---|---|---|---|---|---|---|---|
| Carbonyl Fe powder | X | F1 | Bal | — | — | 1.1 | 0.3 | 1.1 | 1.8 |
| | ○ | F2 | Bal | — | — | 1.0 | 0.3 | 1.2 | 3.4 |
| Atomized Fe powder | ○ | F3 | Bal | — | — | 0.05 | 0.3 | 0.004 | 12.6 |
| | X | F4 | Bal | — | — | 0.07 | 0.4 | 0.005 | 16.3 |
| Reduced Co powder | X | Co1 | — | Bal | — | 0.03 | 0.5 | 0.007 | 0.8 |
| | ○ | Co2 | — | Bal | — | 0.07 | 0.4 | 0.004 | 1.7 |
| | ○ | Co3 | — | Bal | — | 0.04 | 0.4 | 0.004 | 8.9 |
| $Cr_2O_3$ powder | X | Cr1 | — | — | 62.4 | 0.04 | 38.9 | 0.007 | 0.7 |
| | ○ | Cr2 | — | — | 62.7 | 0.05 | 38.7 | 0.007 | 1.4 |
| Metallic Cr powder | ○ | Cr3 | — | — | Bal | 0.02 | 0.3 | 0.003 | 23.7 |
| Atomized Fe—Co powder (classified) | ○ | FCo2 | 49.9 | 49.1 | — | 0.07 | 0.6 | 0.004 | 3.9 |
| | ○ | FCo3 | 49.9 | 49.1 | — | 0.07 | 0.6 | 0.004 | 8.7 |
| | X | FCo4 | 49.9 | 49.1 | — | 0.07 | 0.6 | 0.004 | 11.0 |
| Atomized Fe—Cr powder (classified) | ○ | FCr2 | 49.7 | — | 49.2 | 0.12 | 0.5 | 0.005 | 2.4 |
| | ○ | FCr3 | 49.7 | — | 49.2 | 0.12 | 0.5 | 0.005 | 27.3 |
| | X | FCr4 | 49.7 | — | 49.2 | 0.12 | 0.5 | 0.005 | 31.6 |

Note:
○: Within the invention range.
X: Outside the invention range.

TABLE 7

| No. | Sintered density ratio (%) | Average crystal grain size (μm) | Chemical composition (wt %) Fe | Co | Cr | C | O | Magnetic properties B80 (KG) | Resistivity ρ (μΩcm) | Remarks |
|---|---|---|---|---|---|---|---|---|---|---|
| 4-1 | 97 | 250 | Bal | 18.3 | 2.3 | 0.009 | 0.021 | 22.3 | 24.0 | Comparative Example 7 |
| 4-2 | 97 | 250 | Bal | 22.4 | 2.4 | 0.013 | 0.027 | 23.6 | 24.1 | Example 12 |
| 4-3 | 96 | 320 | Bal | 35.9 | 0.7 | 0.007 | 0.031 | 24.2 | 18.3 | Example 13 |
| 4-4 | 98 | 300 | Bal | 48.2 | 3.2 | 0.005 | 0.019 | 23.9 | 24.5 | Example 14 |
| 4-5 | 96 | 300 | Bal | 52.4 | 2.7 | 0.008 | 0.014 | 19.9 | 24.7 | Comparative Example 8 |
| 4-6 | 98 | 300 | Bal | 36.2 | 0.4 | 0.007 | 0.024 | 23.7 | 8.2 | Comparative Example 9 |

TABLE 8

| No. | Sintered density ratio (%) | Average crystal grain size (μm) | Chemical composition (wt %) Fe | Co | Cr | C | O | Magnetic properties B80 (KG) | Resistivity ρ (μΩcm) | Remarks |
|---|---|---|---|---|---|---|---|---|---|---|
| 5-1 | 97 | 400 | Bal | 40.2 | 1.7 | 0.011 | 0.017 | 22.4 | 21.7 | Example 15 |
| 5-2 | 93 | 420 | Bal | 39.6 | 1.6 | 0.008 | 0.019 | 18.7 | 22.3 | Comparative Example 10 |

TABLE 9

| No. | Sintered density ratio (%) | Average crystal grain size (μm) | Chemical composition (wt %) Fe | Co | Cr | C | O | Magnetic properties B80 (KG) | Resistivity ρ (μΩcm) | Remarks |
|---|---|---|---|---|---|---|---|---|---|---|
| 6-1 | 97 | 180 | Bal | 26.8 | 0.59 | 0.007 | 0.032 | 22.7 | 22.6 | Example 16 |
| 6-2 | 97 | 44 | Bal | 27.3 | 0.54 | 0.009 | 0.019 | 19.1 | 21.7 | Comparative |

TABLE 9-continued

| No. | Sintered density ratio (%) | Average crystal grain size (μm) | Chemical composition (wt %) Fe | Co | Cr | C | O | Magnetic properties B80 (KG) | Resistivity ρ (μΩcm) | Remarks |
|---|---|---|---|---|---|---|---|---|---|---|
| | | | | | | | | | | Example 11 |

EXAMPLE 8

The debound green bodies of No. 3-1 of Example 3, said bodies having the adjusted C and 0 contents, were provided. The debound green bodies of No. 4-2 of Example 4 were also provided.

Sintering was conducted by holding the debound bodies at 1140° C. for 1 hour under the conditions of the reduced-pressure conditions of the first stage in varied atmospheres, respectively. All the bodies were then held at 1320° C. for 2 hours in argon gas of the atmospheric pressure to obtain sintered bodies. However, the vacuum level was adjusted and controlled during the reduced-pressure sintering by restricting a valve of a vacuum evacuation system or by leaving the vacuum evacuation system as was and instead introducing a small amount of argon gas through a needle valve. The sintered bodies were tested in a similar manner to Example 3 or Example 4. The sintering conditions, chemical compositions, density ratios, magnetic properties, electrical resistivities of the sintered bodies are summarized in Table 10. In Table 10, when the vacuum level was adjusted by restricting the valve of the vacuum evacuation system, the thus-adjusted pressure is indicated and when the vacuum level was adjusted by the introduction of a small amount of argon gas, "Ar" is given immediately after the pressure.

As is apparent from Table 10, when the vacuum evacuation was insufficient and the vacuum level was decreased upon sintering in a vacuum (compare Example Nos. 7-1, 7-2, 7-7 and 7-8 to Comparative Example Nos. 7-3 and 7-9), the resultant sintered bodies had high C and 0 contents. Significant deterioration of the magnetic properties (especially Hc and $\mu_{max}$) took place at a vacuum level of 0.1 Torr (Comparative Example No. 7-3) in Fe-Co-V type compositions or at a vacuum level of 0.5 Torr (Comparative Example No. 7-9) in Fe-Co-Cr compositions. However, low C and 0 contents were obtained at vacuum levels not higher than 0.05 Torr (Example Nos. 7-1 and 7-2) in Fe-Co-V compositions and a vacuum levels not higher than 0.1 Torr (Example Nos. 7-7 and 7-8) in Fe-Co-Cr compositions, so that excellent magnetic properties were obtained.

On the other hand, when sufficient vacuum evacuation was conducted and a non-oxidizing gas was introduced (Example Nos. 7-4, 7-5, 7-10 and 7-11 and Comparative Example Nos. 7-6 and 7-12), no deteriorations of the magnetic properties were observed on both Fe-Co-V and Fe-Co-Cr compositions at increased furnace pressures up to less than 30 Torr (Example Nos. 7-4, 7-5, 7-10 and 7-11), although some increases of the C and 0 contents were observed. When the pressure exceeded 30 Torr (Comparative Example No. 7-6 and 7-12) exceeded 30 Torr, the contents of C and 0 increased significantly. The magnetic properties were therefore deteriorated.

As has been demonstrated above, a sintered body having excellent magnetic properties can be obtained for the first time in accordance with the production process of this invention by conducting evacuation thoroughly in reduced-pressure sintering, namely, to 0.05 Torr or lower for an Fe-Co-V composition, 0.1 Torr or lower for an Fe-Co-Cr composition, or to vacuum levels lower than 30 Torr irrespective of the composition when a non-oxidizing gas is introduced.

TABLE 10

| No. | First-stage heat treatment Atmosphere | (°C.) | Second-stage heat treatment Atmosphere | (°C.) | Chemical components of sintered body* Co Content (wt %) | V or Cr Content (wt %) | O Content (wt %) | C Content (wt %) | Density ratio (%) | Magnetic properties** B (KG) | Hc (Oe) | μmax (—) | Electrical resistivity (μΩcm) | Remarks |
|---|---|---|---|---|---|---|---|---|---|---|---|---|---|---|
| 7-1 | 0.001 Torr | 1140 | 1 atm Ar | 1320 | 48.4 | 2.1 (V) | 0.33 | 0.01 | 95.6 | 19.5 (20) | 1.1 | 4200 | 42 | Example 17 |
| 7-2 | 0.01 Torr | 1140 | 1 atm Ar | 1320 | 48.4 | 2.1 (V) | 0.36 | 0.03 | 95.6 | 19.0 (20) | 1.5 | 3600 | 44 | Example 18 |
| 7-3 | 0.1 Torr | 1140 | 1 atm Ar | 1320 | 48.4 | 2.1 (V) | 0.43 | 0.08 | 95.7 | 16.8 (20) | 4.8 | 1500 | 45 | Comparative Example 12 |
| 7-4 | 1 Torr Ar | 1140 | 1 atm Ar | 1320 | 48.4 | 2.1 (V) | 0.34 | 0.02 | 95.6 | 19.3 (20) | 1.3 | 3800 | 42 | Example 19 |
| 7-5 | 10 Torr Ar | 1140 | 1 atm Ar | 1320 | 48.4 | 2.1 (V) | 0.37 | 0.03 | 95.5 | 19.0 (20) | 1.6 | 3500 | 44 | Example 20 |
| 7-6 | 50 Torr Ar | 1140 | 1 atm Ar | 1320 | 48.4 | 2.1 (V) | 0.44 | 0.08 | 95.6 | 17.0 (20) | 4.5 | 1600 | 45 | Comparative Example 13 |
| 7-7 | 0.001 Torr | 1140 | 1 atm Ar | 1320 | 22.4 | 2.4 (Cr) | 0.020 | 0.010 | 97.2 | 23.6 (80) | — *** | — | 24.0 | Example 21 |
| 7-8 | 0.05 Torr | 1140 | 1 atm Ar | 1320 | 22.4 | 2.4 (Cr) | 0.025 | 0.012 | 97.1 | 23.6 (80) | — | — | 24.1 | Example 22 |
| 7-9 | 0.5 Torr | 1140 | 1 atm Ar | 1320 | 22.4 | 2.4 (Cr) | 0.058 | 0.032 | 97.2 | 22.3 (80) | — | — | 24.8 | Comparative Example 14 |
| 7-10 | 1 Torr Ar | 1140 | 1 atm Ar | 1320 | 22.4 | 2.4 (Cr) | 0.020 | 0.012 | 97.2 | 23.6 (80) | — | — | 24.0 | Example 23 |
| 7-11 | 10 Torr Ar | 1140 | 1 atm Ar | 1320 | 22.4 | 2.4 (Cr) | 0.032 | 0.018 | 97.3 | 23.4 (80) | — | — | 24.0 | Example 24 |
| 7-12 | 50 Torr Ar | 1140 | 1 atm Ar | 1320 | 22.4 | 2.4 | 0.060 | 0.043 | 97.0 | 21.6 | — | — | 25.0 | Comparative |

TABLE 10-continued

| No. | First-stage heat treatment Atmosphere | First-stage heat treatment (°C.) | Second-stage heat treatment Atmosphere | Second-stage heat treatment (°C.) | Chemical components of sintered body* Co Content (wt %) | V or Cr Content (wt %) | O Content (wt %) | C Content (wt %) | Density ratio (%) | Magnetic properties** B (KG) | Hc (Oe) | μmax (−) | Electrical resistivity (μΩcm) | Remarks |
|---|---|---|---|---|---|---|---|---|---|---|---|---|---|---|
| | | | | | | (Cr) | | | | (80) | | | | Example 15 |

*Analytical data for the elements in parentheses.
**"20" in parentheses indicates $B_2$, while "80" in parentheses indicates $B_{80}$.
***"—" indicates that no measurement was conducted.

POSSIBLE EXPLOITATION IN INDUSTRY

According to this invention, sintered Fe-Co type materials having an intricate shape and superior magnetic properties to conventional sintered materials can be obtained by an economical process without need for such extreme high temperature and/or high pressure as required in the conventional processes.

When V is introduced as a third component to Fe-Co systems in accordance with this invention, sintered Fe-Co type magnetic materials having excellent ac magnetic properties can be obtained by removing C, which is derived from an organic binder, without inducing extreme oxidation.

When Cr is introduced as a third component to Fe-Co system in accordance with this invention, Sintered Fe-Co-Cr type materials having excellent magnetic properties and a low iron loss value can be obtained.

The magnetic materials of this invention can be used widely as soft magnetic materials in motors, magnetic yokes and the like, especially, as cores of printing heads of office automation machines.

We claim:

1. A sintered Fe-Co type magnetic material comprising 15–60 wt. % of Co, not greater than 0.04 wt. % of O, not greater than 0.02 wt. % of C and the remainder of Fe and imperative impurities, having a sintered density ratio of at least 95% and an average crystal grain size of at least 50 μm.

2. A sintered Fe-Co type magnetic material comprising 15–60 wt. % of Co, 0.5–3.5 wt. % of V, not greater than 0.6 wt. % of O, not greater than 0.04 wt. % of C and the remainder of Fe and imperative impurities, having a sintered density ratio of at least 95% and an average crystal grain size of at least 50 μm.

3. A sintered Fe-Co type magnetic material comprising 20–50 wt. % of Co, 0.5–3.5 wt. % of Cr, not greater than 0.04 wt. % of O, not greater than 0.02 wt. % of C and the remainder of Fe and imperative impurities, having a sintered density ratio of at least 95% and an average crystal grain size of at least 50 μm.

* * * * *

UNITED STATES PATENT AND TRADEMARK OFFICE

CERTIFICATE OF CORRECTION

PATENT NO. : 5,055,128

DATED : October 8, 1991

INVENTOR(S) : Yoshisato Kiyota et al

It is certified that error appears in the above-identified patent and that said Letters Patent is hereby corrected as shown below:

In columns 9 and 10, in Table 2, under the subheading "Raw material powder" at No. 13, please change "(14." to --(14.1--.

In column 16, line 56, please change "Hsc" to --Hc--; and line 57, before "lower", first occurrence, insert as a new paragraph the following --By controlling the proportions of C and O to 0.02 wt.% or--.

In column 17, after line 3, insert the title --Sintered density ratio: 95% min.--.

In column 19, line 37, please change "ion" to --in--; line 47, after "2-2" delete ")"; and line 54, please change "60" to --α--.

In Column 27, in Table 10-continued, the line beginning with "**", please change "$B_2$" to --$B_2O$--.

Signed and Sealed this

Fourth Day of May, 1993

*Attest:*

*Attesting Officer*

Michael K. Kirk

MICHAEL K. KIRK

*Acting Commissioner of Patents and Trademarks*